United States Patent [19]

Fujiura

[11] Patent Number: 4,941,849

[45] Date of Patent: Jul. 17, 1990

[54] SHIELDED ELECTRICAL CONNECTOR HAVING AN INSULATING COVER ON THE SHIELDING MEMBER

[75] Inventor: Yoshitsugu Fujiura, Tokyo, Japan

[73] Assignee: AMP Incorporated, Harrisburg, Pa.

[21] Appl. No.: 234,998

[22] Filed: Jul. 13, 1988

[30] Foreign Application Priority Data

Dec. 12, 1986 [JP] Japan ..... 61-296525
Nov. 16, 1987. [WO] PCT Int'l Appl. ... PCT/US87/02983

[51] Int. Cl.[5] ..... H01R 9/03
[52] U.S. Cl. ..... 439/610; 439/357
[58] Field of Search ..... 439/350, 352, 353, 354, 439/356, 357, 358, 355, 372, 391, 395, 607, 608, 609, 610, 629, 630, 632, 59, 62, 76, 78, 79, 80, 81, 83, 554, 573

[56] References Cited

U.S. PATENT DOCUMENTS

| | | | |
|---|---|---|---|
| 4,319,733 | 3/1982 | Hanna et al. | 248/507 |
| 4,571,912 | 2/1986 | Bassler et al. | 52/710 |
| 4,577,919 | 3/1986 | Waters | 439/597 |
| 4,619,494 | 10/1986 | Noorily et al. | 439/449 |
| 4,621,885 | 11/1986 | Szczesny et al. | 439/357 |
| 4,653,825 | 3/1987 | Olsson | 439/607 X |
| 4,693,533 | 9/1987 | Szczesny et al. | 439/350 |
| 4,699,438 | 10/1987 | Kikuta | 439/95 |
| 4,722,022 | 1/1988 | Myers et al. | 361/424 |
| 4,726,791 | 2/1988 | Rudy, Jr. et al. | 439/677 |
| 4,735,583 | 4/1988 | Rudy, Jr. et al. | 439/350 |
| 4,762,505 | 8/1988 | Asick et al. | 439/347 |

*Primary Examiner*—Neil Abrams
*Assistant Examiner*—Khiem Nguyen
*Attorney, Agent, or Firm*—Adrian J. LaRue

[57] ABSTRACT

A shielded electrical connector (1) comprises an insulating housing (40) having electrical contacts (45) secured therein to which are to be electrically connected insulated electrical conductors (73) of a shielded electrical cable (7). A shielding member (20) is mounted on the housing (40) covering the electrical contacts and electrically connectable to the shield (72) of cable (7). An insulating cover (10) is mounted on the shielding member (20) and has metal latching members (3) secured in respective sides thereof and they include latching sections (31) for latching engagement with latching sections of a complementary electrical connector when the connectors are connected together. An operator engages only the insulating cover (10) when connecting the shielded connector to the complementary connector and disconnecting it therefrom so as not to transmit static electrical charges from the person to the electrical conductors and connections.

7 Claims, 6 Drawing Sheets

SHIELDED ELECTRICAL CONNECTOR HAVING AN INSULATING COVER ON THE SHIELDING MEMBER

BACKGROUND OF THE INVENTION

The present invention relates to a shielded electrical connector for terminating an end of a shielded cable and more particularly to a shielded electrical connector having an insulating cover on the shielding member of the connector.

A shielded cable is composed of electrical conductors for transmitting signals which includes a shielding material, such as a metal mesh and the like, to prevent the intrusion of external signals An electrical connector for terminating such a shielded cable includes a metal shielding member which covers the termination between the electrical conductors and each electrical contact to prevent the external signals from affecting the signals being transmitted along the conductors and such terminations. In this connector, however, a problem may arise in that, if the metal shielding member is left exposed, static electric charges transmitted by the hands of a person to the shielding member during connection of the connector to a matchable connector may infiltrate into the system with which the cable is connected thereby causing an undesirable influence on the system. In order to use a shielded connector as mentioned above, the shielding member is covered with an insulating material in the form of an insulating cover which is secured on the shielding member by means of bolts which also secure the connector onto a mating electrical connector.

The use of such bolts, however, has disadvantages in that the bolting and unbolting of the connector is not expedient and a large space is required for the bolts thereby resulting in a large size connector. To overcome these disadvantages, the shielding member or the insulating cover may be provided with latching members that latchably engage the mating connector thereby firmly latching the connector on the mating connector. However, it is difficult to form the latching members as part of the metal shielding member. On the other hand, although the integral formation of latching members on the insulating cover is possible, the latching engagement of the latching members with the mating connector is rather weak on account of the lack of rigidity of the rubber or plastic material used for the insulating cover.

SUMMARY OF THE INVENTION

The present invention is intended to solve the above-mentioned problems accompanying a conventional shielded connector by providing a shielded connector having latching members, which can be easily latched with and unlatched from a mating connector, and yet provides sufficiently strong latching engagement therebetween.

The electrical connector comprises an insulating housing covered with a metal shielding member which has a first opening along which contact portions of electrical contacts extend and a second opening through which and end of a shielded cable and exposed insulated electrical conductors extend which are connected with respective conductor-connecting portions of the contacts. Openings are located between the shielding member and an insulating cover on the shielding member and they extend away from the end of the first opening. A latching member, which can engage with its mating latching member of a mating electrical connector, is retained in each of the openings with its engaging portion projecting towards the first opening.

Engagement and disengagement of the above-mentioned connector with the mating connector can be accomplished by handling only the insulating cover without touching the shielding member. Thus, the mating parts are not affected by the static electric charges transferred from a body of the person handling the connector during such engagement or disengagement. Also, because the connectors are adapted to latch each other together by means of the firm latching of the latching members, latching and unlatching of the matable connectors is easy, and, because of the strength of the metal latching members, secure latching engagement between the connectors is affected.

According to another embodiment of the present invention, an electrical connector comprises a dielectric housing having contact sections of electrical contacts positioned in passageways of the housing and post sections of an upper row of contacts being located in an outer row while post sections of a lower row of contacts are disposed in an inner row. Conductive-engaging sections of the outer row of post sections are electrically connectable to conductive members on an upper surface of a circuit board whereas conductive-engaging sections of the inner row of post sections are electrically connectable to conductive members on a bottom surface of the circuit board.

An electrical connector according to this invention will now be described by way of example with reference to the following detailed description with reference to the accompanying drawings, in which:

DETAILED DESCRIPTION OF THE EMBODIMENT

Figure 1:
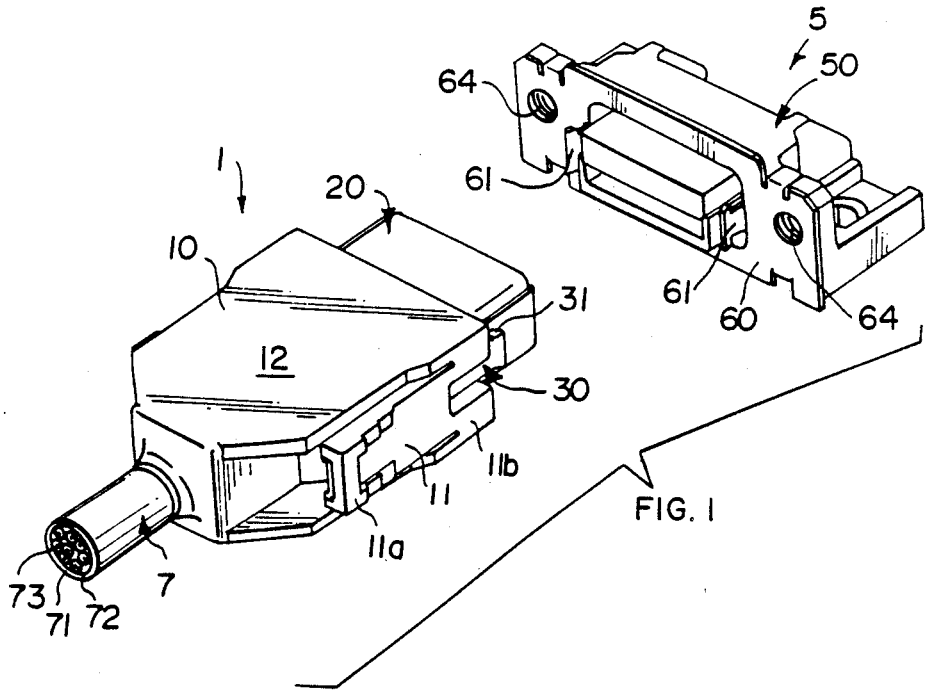
FIG. 1 is an exploded perspective view of a shielded electrical connector of the invention and a mating electrical connector.
Figure 2:
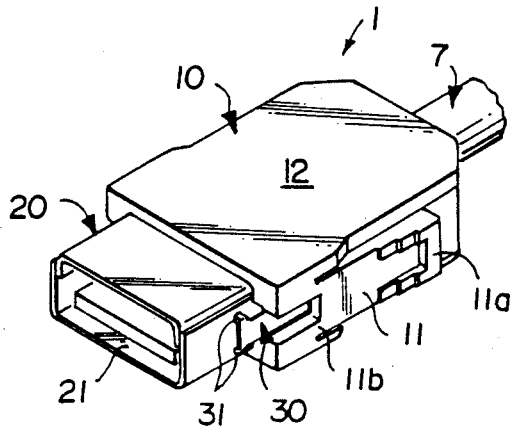
FIG. 2 is another perspective view of the shielded connector shown in FIG. 1.

FIG. 1 is a perspective view of a shielded electrical connector 1 according to the invention and a mating electrical connector 5 with which the connector is to be electrically connected. Shielded connector 1 is electrically connected to one end of a shielded cable 7. Inside connector 1, a dielectric housing 40 is located which holds a multiplicity of electrical contacts 45; each contact 45 is connected with respective insulated electrical conductors 73 in cable 7. Housing 40 is covered with a metal shielding member 20 mounted thereon, which member 20 is in turn mostly covered with an insulating cover 10 mounted thereon. Each of multiple insulated electrical conductors 73 in shielded cable 7 is shielded by means of a woven shielding material 72 such as a metal mesh illustrated in cross section in FIG. 3. As shown in FIG. 2, shielding member 20 is provided with a first opening 21 at its front end, through which opening the connecting contact portions (not shown) of the electrical contacts extend.

Latching members 30 that extend from the front toward the rear of cover 10 are inserted and fixed in the spaces between the portions of shielding member 20 on the right and left sides of connector 1 and insulating cover 10. Latching members 30 include latching sections 31 which latchably engage the latching sections of the mating connector. Further, on opposite sides, insulating cover 10 is provided with flexible arms 11 having engaging portions 11*a* at their rear ends, and front portions 11*b* which pivotally connect to the body of insulating cover 10 so that arms 11 extend along the respective sides of the cover.

Mating connector 5 comprises an insulating housing 50 having a multiplicity of electrical contacts to be connected with the contacts of shielded connector 1. A shield member 60 is mounted on the front end of housing 50 for electrical engagement with the shielding member 20 of shielded connector 1. Latching members 61 are located on shield member 60 protruding outwardly therefrom.

Figure 3:
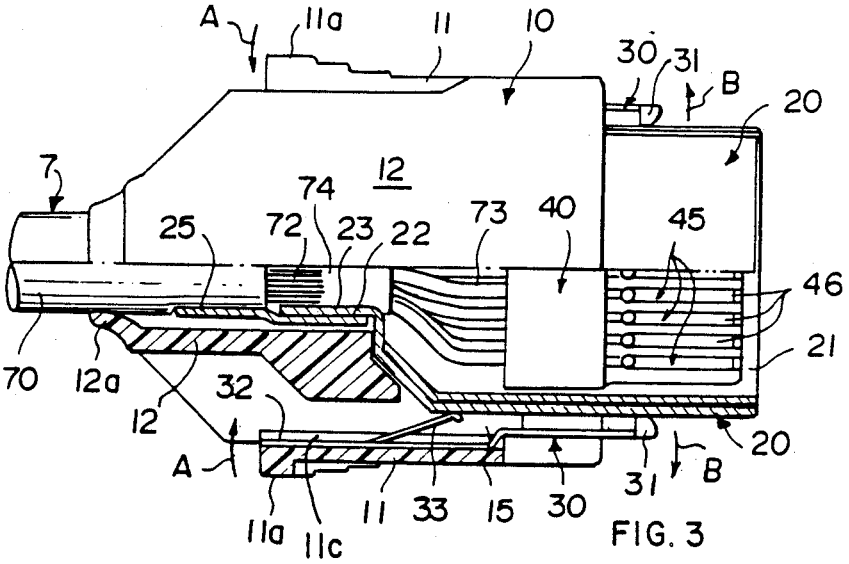
FIG. 3 is a top plan view of the shielded connector with half of the connector shown in cross section.
Figure 4:
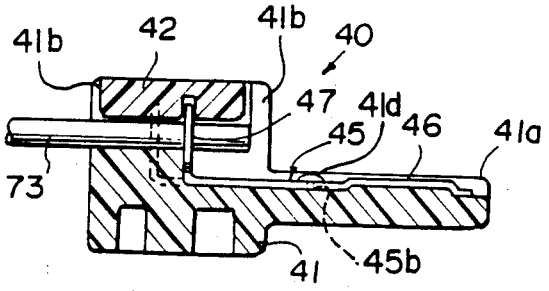
FIGS. 4 and 5 are respectively a cross section and a perspective view of the insulating housing of the shielded connector.
Figure 5:
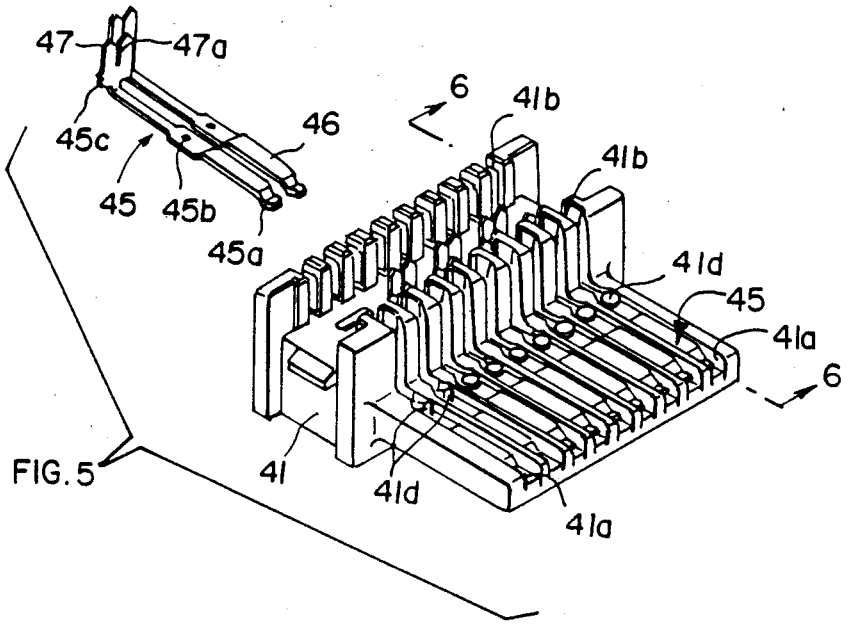

Insulating housing 40, as shown in FIGS. 3–5, holds therein a multiplicity of electrical contacts 45 in an array. Shielding member 20 covers insulating housing 40 which includes a lower member 41 and an upper member 42 as shown in FIGS. 4 and 5 (upper member 42 is not shown in FIG. 5). The multiplicity of electrical contacts 45 are each inserted in respective retention grooves 41*a* formed on an upper front surface of lower member 41.

Each contact 45 is formed as an L-shaped metal plate and has a contact portion 46 as part of the long leg of the metal plate and a short leg conductor-connection portion 47 extending upward. Contact portion 46 electrically engages in a wiping manner along a corresponding electrical contact of mating connector 5 when connectors 1 and 5 are mated to form an electrical connection therebetween Conductor-connection portion 47 is electrically connected to the conductor core of a corresponding conductor 73 of shielded cable 7 when conductor 73 is forced into a corresponding slot 47*a* causing the edges thereof to cut into the insulation thereby electrically engaging the conductor core of conductor 73.

Each contact 45 also has first protrusion 45*a* at its front end and extending laterally from both sides thereof, and second protrusions 45*c* located on conductor-connection portion 47 and extending laterally from both sides thereof. When contacts 45 are inserted into retention grooves 41*a*, first and second protrusions 45*a*, 45*c* are forced respectively in retention grooves 41*a*, they bite into the side surfaces of the retention grooves thereby retaining contacts 45 therein. Further, each contact 45 contains a retention hole 45*b* intermediate the contact into which extends a retention protrusion 41*d* provided in groove 41*a*. By applying heat to retention protrusions 41*d*, they are deformed thereby positively securing contacts 45 in grooves 41*a*. When contacts 45 are each secured in respective retention grooves 41*a*, conductor-connection portions 47 are positioned in an upward direction, and insulated conductors 73 of shielded cable 7 are force fitted in slots 47*a* of respective conductor-connection portions 47, the edges of slots 47*a* cutting into the insulation of the conductors thereby electrically connecting the conductor cores with the conductor-connection portions 47. It is to be noted that as the insulated wires 73 are thus force fitted into slots 47*a*, they are guided by a multiplicity of guiding grooves 41*b* in spaced upper portions of lower member 41. After the completion of the termination of conductors 73 to contacts 45, upper member 42 is latchably mounted onto lower member 41 so as to maintain conductors 73 in slots 47*a* and protect the terminations therebetween.

After conductors 73 are each connected with respective contacts 45, shielding member 20 is mounted onto insulating housing 40. Shielding member 20 is formed from two interengaging members of good electrical conducting material such as brass, with its front section being box-shaped and its rear section being drawn into a cylindrical configuration that receives shielded cable 7. Shielding member 20 is provided at its front end with a first opening 21 along which contact portions 46 of contacts 45 extend and at the backend with second opening 23 for receiving an exposed section of the shield 72 and the inner insulation jacket 74 in which conductors 73 are located. A cylindrical ferrule 25 is disposed onto cylindrical portion 22 forming second opening 23 which via an interference fit maintains the sections forming cylindrical portion 22 in engagement with each other and with the exposed shielding material 72. Ferrule 25 also engages the end of cable 7 and is crimped thereon to form a strain relief.

Next, insulating cover 10, which is made of stifflyflexible insulating material such as polyolefin, is positioned over the outer surface of shielding member 20. Insulating cover 10 comprises a body 12 to cover the rear section of shielding member 20 and arms 11 extending along the opposite sides of body 12. Arms 11 are integrally connected with body 12 at front portions 11*b* and they extend towards the rear end of body 12; arms 11 are provided with engaging portions 11*a*. Cover body 12 has a first opening at its front end from which the front end of shielding member 20 projects forwardly, and at its rear end a second opening through which shielded cable 7 extends which has been connected with contacts 45 in insulating housing 40. Inner end 12*a* of body 12 tightly engages outer insulation jacket 70 of cable 7 as shown in FIG. 3.

Figure 6:
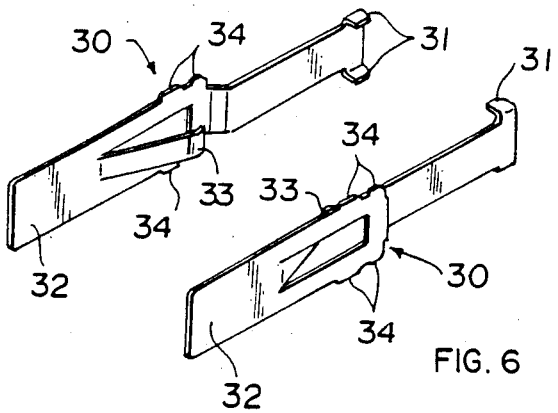
FIG. 6 is a perspective view of the latching members for use in the shielded connector.

Openings 15 in insulating cover 10 extend between arms 11 and respective opposite sides of shielding member 20. A latching member 30 is force fitted into a channel-shaped recess 11*c* extending along an inside surface of each arm 11. A pair of such latching members 30 shown perspectively in FIG. 6 are fabricated from a sheet metal such as stainless steel into the shape as shown. Latching members 30 each have inwardly-bend portions or latching sections 31 at their front ends and fulcrum arms 33 intermediate their ends. Further, on the upper and lower edges of the locking member 30 are located latching protrusions 34 which bite into the sides of the channel-shaped recesses of arms 11 thereby firmly securing latching members 30 therein along openings 15.

Front sections of members 30 containing latching sections 31 extend forwardly from a front end of cover 10 and along respective sides of shielding member 20 as shown in FIGS. 2 and 3. Fulcrum arms 33 abut against the sides of shielding member 20 so that rear ends 32 are located at a position corresponding to engaging portions 11*a* of arms 11. Thus, when engaging portions 11*a* are pushed inwardly (in the direction indicated by arrow A), arms 11 pivot about front portions 11*b* which in turn move rear ends 32 of latching members 30 inwardly. With this motion, latching members 30 pivot about fulcrum arms 33 so that the front ends containing latching sections 31 are moved outwardly (in the direction indicated by arrow B). These latching sections 31 engage latching sections 61 of mating connector 5 when connectors 1 and 5 are mated, thereby latching them together.

Thus, the engagement and the disengagement between latching sections 31 and 61 can be accomplished by pushing engaging portions 11*a* which is followed by the movement of the latching sections 31. Accordingly, when it is desired to connect or disconnect mating connector 5 with shielded connector 1, connection or disconnection can be easily done by pushing onto engaging portions 11*a* to thereby release the latching engagement between latching sections 31 and 61. In this case, since latching members 30 are made of a strong material such as stainless steel, the latching engagement of the latching sections is firm enough to securely hold both electrical connectors together. Further, latching members 30 are made thin, as shown in FIG. 6, so as not to make the size of the shielded connector larger and still perform a positive latching operation.

Figure 7:
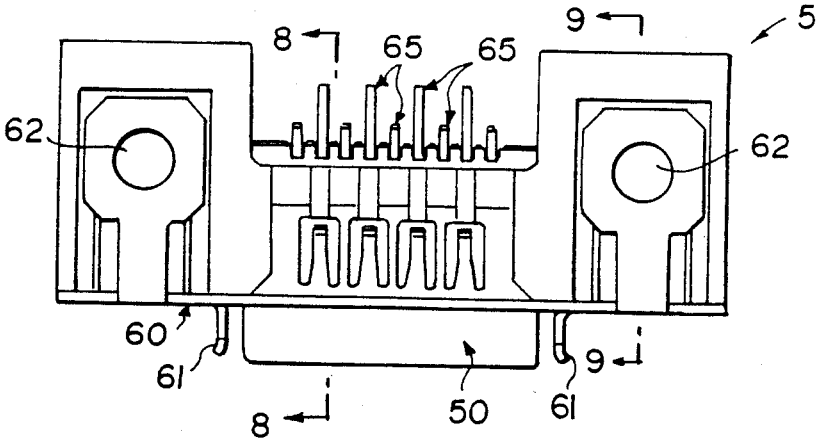
FIGS. 7 through 9 are a respective bottom plan view of the mating connector and its cross sections taken on the lines VIII—VIII and IX—IX, of FIG. 7.
Figure 8:
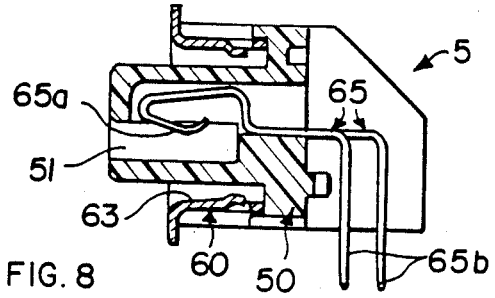
Figure 9:
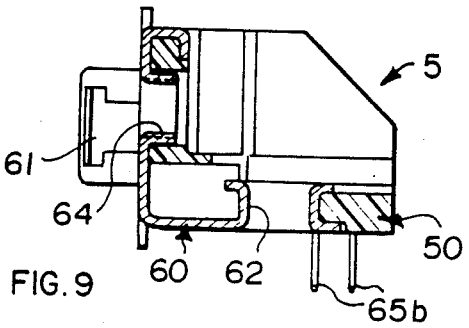

Mating connector 5, as shown in FIGS. 7–9, comprises an insulating housing 50 made of a suitable insulating material and a shielding member 60. Insulating housing 50 has a multiplicity of electrical contacts 65 secured in an array therein. An opening 51 is located in a front end of housing 50 for receiving the front end of insulating housing 40 of shielded connector 1. Spring contact portions 65*a* of contacts 65 project into opening 51. As the front end of insulating housing 40 of shielded connector 1 is inserted into opening 51, contact portions 46 of contacts 45 slidably electrically engage contact portions 65*a* of contacts 65 to establish electric connection therebetween. It can be seen that contact posts 65*b* of contacts 65 secured in insulating housing 50 project outwardly from and downwardly along the rear surface of housing 50. Shielding member 60 has at its front end a flange 63 that receives the front end of shielding member 20 of shielded connector 1 in electrical engagement therewith. On the right and left sides of flange 63 are located latching sections 61 which protrude forwardly. Shielding member 60 is provided with bolt-insertion holes 62 for bolting mating connector 5 on a circuit board.

Figure 10:
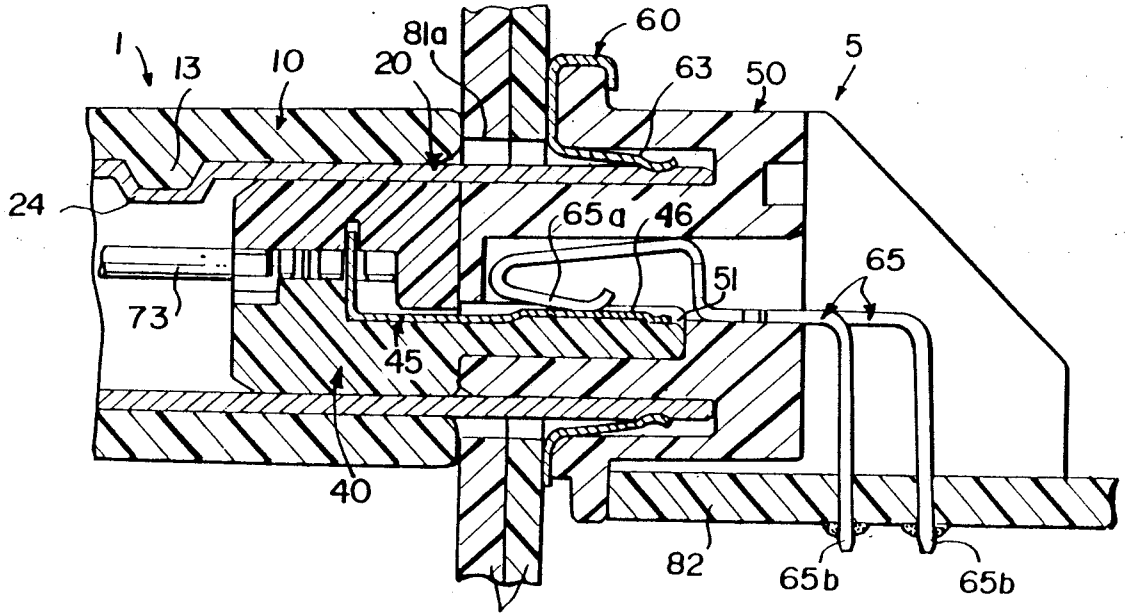
FIGS. 10 and 11 are respective cross sections of the shielded connector and the mating connector of FIGS. 1–9 and an embodiment thereof in the connected condition.

In this case as shown in FIG. 10, mating connector 5 is bolted on a first board or boards 81 by bolts (not shown) through bolt-insertion holes 64, and on a second board 82 by bolts (not shown) through bolt-insertion holes 62 with a front section of the connector being disposed in opening 81*a*. When connectors 1, 5 are connected, the front end of shielding member 20 is received along flange 63 of shielding member 60 and they electrically engage against each other, and the corresponding contacts 45, 65 of connectors 1, 5 electrically engage one another along contact portions 46, 65*a*. Contact posts 65*b* of contacts 65 are inserted through respective holes of second board 82 and soldered to conductive areas thereof. As can be seen in FIG. 10, a depression 24 is located in shielding member 20 in which a projection 13 on an inside surface of insulating cover 10 fits so as to maintain insulating cover 10 in position on shielding member 20.

Figure 11:
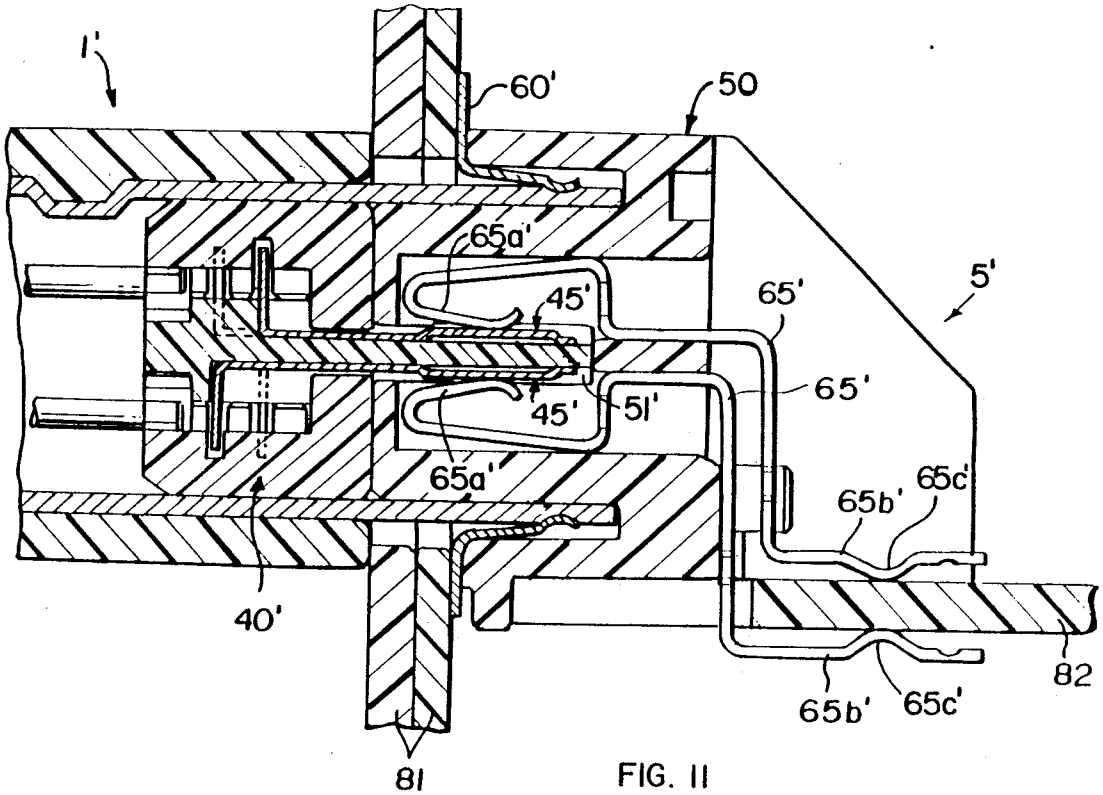

FIG. 11 shows another embodiment of the shielded connector 1' according to the invention, wherein contacts 45' are located in upper and lower rows of insulating housing 40' in shielded connector 1', and contacts 65' are also disposed in upper and lower rows of insulating housing 60' in mating connector 5' with contact portions 65*a*40 extending into opening 51'. Contact posts 65*b'* of contacts 65' have contact sections 65*c'* that extend along opposite surfaces of second board 82, so that they can make electrical connection with conductive areas on either surface of second board 82.

As described above, the shielded electrical connector comprises an insulating housing that holds a multiplicity of contacts therein in an array which is covered with a metal shielding member having a first opening along which contact portions of the contacts are disposed and a second opening through which extend a shielded cable and insulated electric conductors which are connected with respective conductor-connection portions of the contacts. The metal shielding member is covered with an insulating cover, and latching members are disposed between the shielding member and the insulating cover, the latching members having latching sections which project towards the first opening to latchably engage the latching sections of a matable electrical connector when they are mated together. The connector in accordance with the invention can be latched to or unlatched from a mating connector by touching the insulating cover only, without touching by hand the shielding member and the latching members; consequently the connectors are not affected by the static electric charges transferred from a human body. Further, in latching the connector to the mating connector, since the latching members are adapted to latch with the latching members of the mating connector to firmly latch the connectors in position, latching and unlatching of the connectors is not only easy but the latching is also secure due to the strong latching forces of the metal latching members. Furthermore, the connector can be made compact since the latching members placed along the sides of the shielded connector are thin.

I claim:

1. A shielded electrical connector comprising an insulating housing having electrical contacts secured in the housing, the electrical contacts having contact portions and conductor-connection portions for electrical connection to insulated electrical conductors of a shielded cable, a shielding member covering the insulating housing and for electrical connection with a shield of the cable, an insulating cover positioned on the shielding member, characterized in that:

said insulating cover has flexible arms and openings extending along respective sides between the shielding member and the insulating cover;

latching members having sections positioned respectively in said flexible arms and in said openings and latching sections extending forwardly from said insulating cover for latching engagement with latching sections of a matable electrical connector; and fulcrums provided between the latching members and the shielding member enabling the sections and latching sections to move toward and away from the shielding member.

2. A shielded electrical connector as claimed in claim 1, characterized in that said flexible arms are pivotally mounted to said insulating cover, said flexible arms having channel-shaped recesses extending along inside surfaces thereof in which said sections of said latching members are secured in position.

3. A shielded electrical connector as claimed in claim 1, characterized in that said fulcrums comprise fulcrum members extending outwardly from said sections of said latching members with free ends thereof engaging respective sides of said shielding member.

4. A shielded electrical connector as claimed in claim 1, characterized in that said insulating cover is tightly engageable with the shielded cable.

5. A shielded electrical connector, comprising:

an insulating housing having electrical contacts secured therein, said electrical contacts having contact portions and conductor-connection portions for electrical connection to electrical conductors of a shielded electrical cable;

a shielding member covering the insulating housing and for electrical connection to a shield of the cable;

an insulating cover positioned on said shielding member and having flexible arms along respective sides:

latching members having inner sections secured in said flexible arms and latching section extending forwardly from said insulating cover for latching engagement with latching sections of a matable electrical connector; and means provided between the latching members and the shielding member biasing the inner sections away from the shielding member and the latching sections toward the shielding member.

6. A shielded electrical connector as claimed in claim 5, wherein said insulating cover has openings extending along respective sides thereof between the shielding member and the insulating cover along which said latching sections extend.

7. A shielded electrical connector as claimed in claim 5, wherein said means comprise fulcrum members extending outwardly from said inner sections of said latching members and having free ends engaging respective sides of said shielding member.

* * * * *